US005232255A

United States Patent [19]

Palmer et al.

[11] Patent Number: 5,232,255

[45] Date of Patent: Aug. 3, 1993

[54] BUTTON ASSEMBLY

[75] Inventors: Ralph P. Palmer; John S. Shuler, both of Indianapolis; Steve A. Kester, Noblesville, all of Ind.

[73] Assignee: Best Lock Corporation, Indianapolis, Ind.

[21] Appl. No.: 736,603

[22] Filed: Jul. 26, 1991

[51] Int. Cl.[5] ..... E05C 21/00

[52] U.S. Cl. ..... 292/336.3; 292/359; 292/DIG. 64; 70/134

[58] Field of Search ..... 292/336.3, 169.14, 169, 292/347, 169.23, 359, DIG. 64; 70/467-477

[56] References Cited

U.S. PATENT DOCUMENTS

| | | | |
|---|---|---|---|
| 2,693,692 | 11/1954 | Erkkila | 70/146 |
| 2,743,123 | 4/1956 | Alexander | 292/1 |
| 2,834,628 | 5/1958 | Paparelli et al. | 292/347 |
| 3,580,622 | 5/1971 | Morgan | 292/353 |
| 3,800,573 | 4/1974 | Babb, Jr. et al. | 70/217 |
| 4,099,397 | 7/1978 | Dauenbaugh | 70/371 |
| 4,183,569 | 1/1980 | Landfried et al. | 292/347 |
| 4,470,279 | 9/1984 | Neary et al. | 70/134 |
| 4,843,852 | 7/1989 | Foshee et al. | 70/367 |
| 4,966,399 | 10/1990 | Lin | 292/359 |

OTHER PUBLICATIONS

Schlage Button Assembly, one color photograph showing an assembled and a disassembled button assembly.

*Primary Examiner*—Richard E. Moore
*Attorney, Agent, or Firm*—Barnes & Thornburg

[57] ABSTRACT

A button assembly for a button-actuated lockset having a locking mechanism. The button assembly includes a button member and an actuator mechanism such as a locking bar. A rib is provided on the button member to retain the button member on the locking bar yet permit rotation of the button member relative to the locking bar. The button assembly can further include a button cover provided with an engaging mechanism to allow the button cover to be press-fit on the button member.

20 Claims, 2 Drawing Sheets

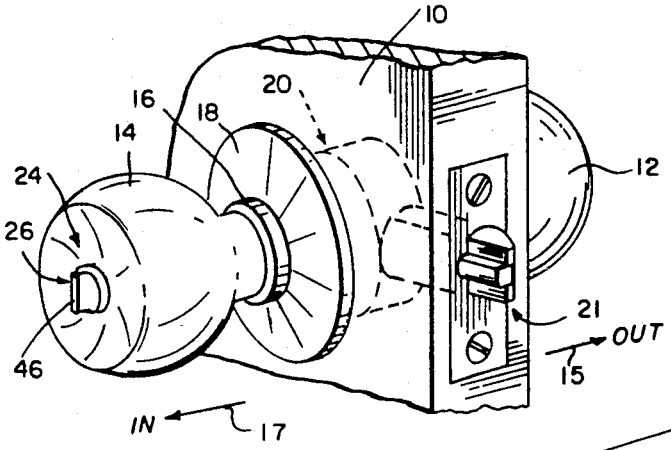
FIG. 1
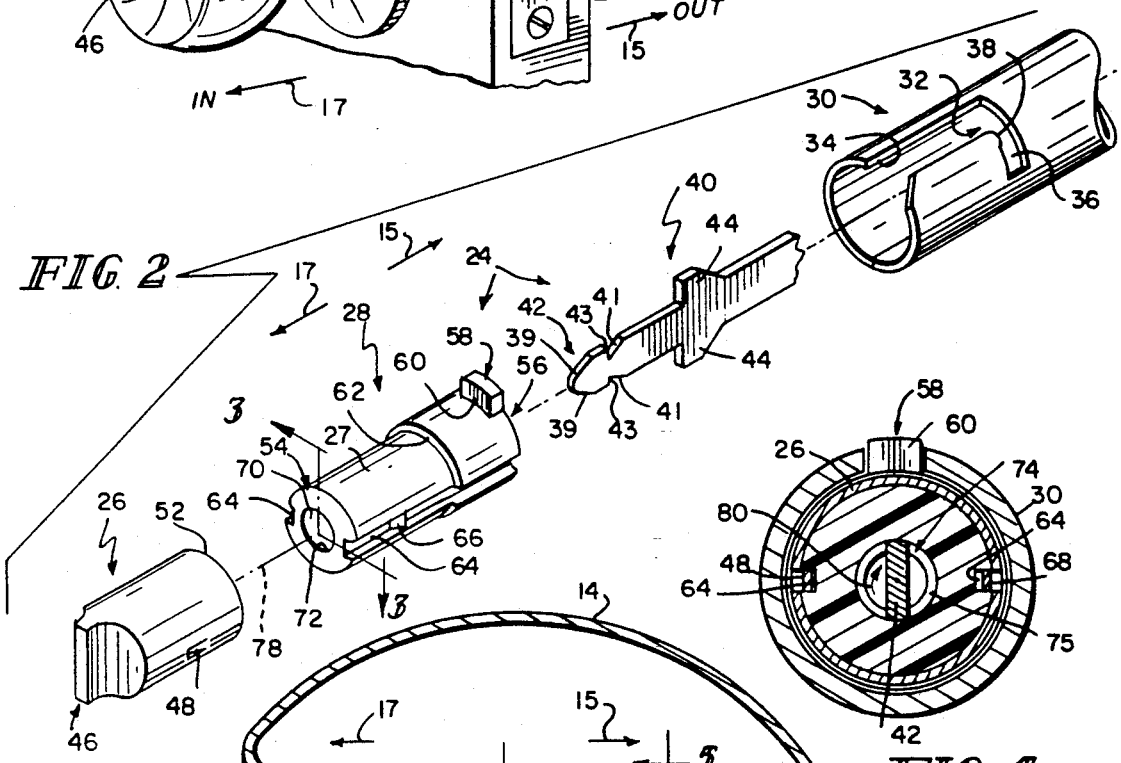
FIG. 2
FIG. 4
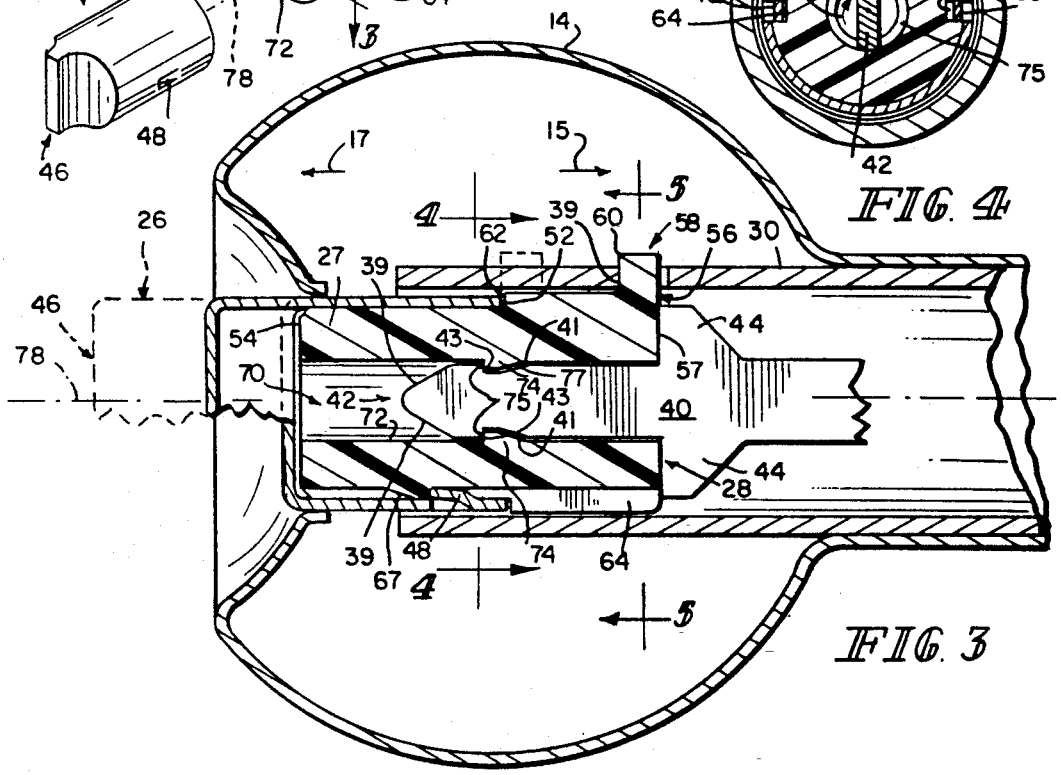
FIG. 3

BUTTON ASSEMBLY

BACKGROUND OF THE INVENTION

This invention relates to a button assembly and particularly to button-actuated cylindrical locksets. More particularly, this invention relates to a button assembly configured for movement within a knob sleeve of a button-actuated cylindrical lockset.

In the manufacture of locksets, it is desirable to minimize assembly time by providing components which can be installed quickly and easily. Particularly, in the manufacture of button-actuated locksets, it is thought that assembly line performance and flexibility can be enhanced by providing a button assembly which can be installed easily in a lockset without disassembly of the lockset and without the use of assembly tools.

In addition, a button assembly typically must perform a number of functions, and some known devices have included separate parts each specifically designed to assist in the performance of a given function. Not only do such button assemblies require time-consuming assembly, but they also may require the maintenance of a large inventory of replacement parts. It is thought that by providing a multifunctional part, inventory can be reduced substantially.

According to the present invention, a button assembly is provided for actuating a locking mechanism of a cylindrical lockset or other lockset. The button assembly includes a locking bar coupled to the locking mechanism and a button member mounted on the locking bar. The button member includes a rib that fits into a notch formed in the locking bar to hold the button member axially in place on the locking bar yet allow the button member to rotate about the longitudinal axis of the locking bar.

In preferred embodiments, the button assembly is mounted in a doorknob so that the button member can be pushed manually into the doorknob to move the locking bar inwardly to actuate the locking mechanism. One end of the locking bar extends into a central aperture formed in the button member and the other end of the locking bar connects to the locking mechanism. The rib is appended to an interior wall of the button member and projects into the central aperture. The rib is formed to include a ramp sized to engage the nose of the locking bar. In assembly, the locking bar is passed into the central aperture and then against and over the ramp provided by the rib so that the rib fits into notches formed in the locking bar. Advantageously, the button assembly provides a button member that is mountable on a locking bar quickly and easily. Moreover, the provision of a rib that is part of the button member and molded in place in the central aperture eliminates the need for a separate, non-rotatable coupling member for attaching a button to a latch mechanism.

The button assembly also includes a button cover that is configured to slide easily onto a tab provided on the external surface of the button member. The button cover provides a grip for a user to manipulate the button member to actuate or release the lock. The button cover includes means for engaging the tab to retain the button cover in a fixed, unrotatable position on the button member. Preferably, the engaging means includes a unidirectional lance formed in the button cover itself. Advantageously, the lance engages the tab when the button cover is press-fit onto the button member, eliminating the need for crimping or staking operations.

The various features and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying Figures in which:

FIG. 1 is a perspective view of a button-actuated cylindrical lock assembly;

FIG. 2 is an exploded perspective view illustrating the various components of the button assembly of FIG. 1 including a button cover, a button member, and a sleeve and locking bar included in the lock assembly;

FIG. 3 is a sectional view of a cylindrical lock assembly taken along lines 3—3 of FIG. 2 with portions broken away to show a connection between an outer portion of the button cover and the button member and a connection between an inner portion of the button member and the locking bar;

FIG. 4 is a cross-sectional view taken along line 4—4 of FIG. 3;

DETAILED DESCRIPTION OF THE DRAWINGS

Figure 5:
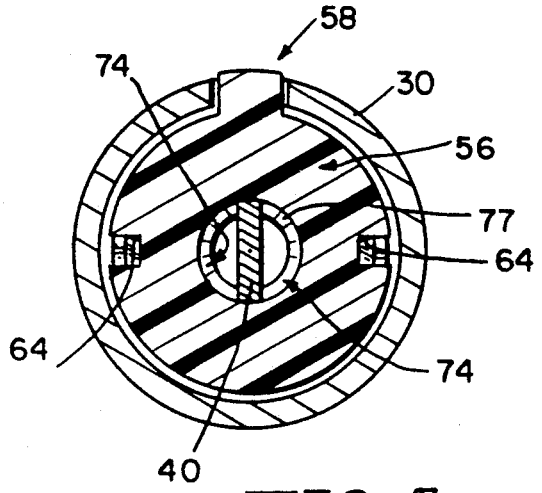
FIG. 5 is a cross-sectional view taken along line 5—5 of FIG. 3.

An embodiment of a door lock assembly incorporating a button assembly in accordance with the present invention is illustrated in FIG. 1. As shown in FIG. 1, a keyed outside knob 12 and an inside knob 14 are mounted in the conventional way to a door 10. Outside knob 12 faces in an axially outward direction designated by arrow 15, while inside knob 14 faces in an axially inward direction designated by arrow 17. An inside rose ring 16 and an inside rose cover 18 encircle inside knob 14 at the intersection of inside knob 14 and door 10. Each knob 12, 14 is operable to actuate a latch assembly 20 (shown in phantom) mounted inside door 10 to actuate a latch bolt 21.

A button assembly 24 extends into inside knob 14 and is connected to a locking mechanism (not shown) for actuation thereof. Manipulation of button assembly 24 permits a user to actuate the locking mechanism easily and then rotate knob 14 to retract the latch assembly 20.

A button assembly 24 in accordance with the present invention is illustrated in FIG. 2. Button assembly 24 advantageously is designed to reduce assembly time and to enable button cover 26 and button member 28 to be assembled without disassembly of the lock assembly. Button assembly 24 illustratively includes a button cover 26, a button member 28, and a locking bar 40. When assembled, button cover 26, button member 28, and locking bar 40 extend into a cylindrical knob sleeve 30 for slidable movement therein. Button member 28 is coupled to the locking bar 40 to allow a user to operate the button member 28, thereby moving the locking bar 40 and controlling actuation of the locking mechanism mounted in the door 10.

Cylindrical knob sleeve 30 is mounted, for example, inside a passageway formed in inside knob 14. Sleeve 30 is configured to receive button assembly 24 and to define a path of travel of button assembly 24 as it is manipulated by the user to actuate the locking mechanism. As shown best in FIG. 2, sleeve 30 is formed to include L-shaped slot 32 including an axially extending long channel 34 communicating with a circumferentially extending short channel 36. Sleeve 30 also includes a boss 38 projecting in an axially inwardly extending direction into circumferentially extending channel 36.

Button cover 26 provides a grip to enable a user to manipulate the button assembly 24. Button cover 26 is preferably formed of brass or like material and includes a grip portion 46. Button cover 26 includes at least one unidirectional lance 48 for retention of button cover 26 on button member 28 in a fixed, unrotatable position. Advantageously, provision of the lance 48 allows the button cover 26 to be press-fit readily onto the button plug member 28 for engagement therewith. Conventional button covers generally require a crimping or staking operation for installation, which often requires assembly tools and results in increased assembly time. Button cover 26 terminates in open end 52. The button cover 26 defines a hollow interior region accessible through open end and sized to receive an end 54 of button member 28 therein.

Button member 28, which is mounted on locking bar 40 and slidably received in cylindrical sleeve 30, provides means for engaging button cover 26, as well as means for moving the locking bar to actuate the locking mechanism. Button member 28 is preferably formed of a plastics material and has an outer end 54 and an inner end 56. Button member 28 also has a radially extending, axially outwardly directed face 57 at inner end 56, as shown in FIG. 3.

In the illustrated embodiment, a locking tab 58 is molded onto button member 28 near inner end 56 and is configured to mate with sleeve 30 to lock the button assembly 24 to sleeve 30. Locking tab 58 extends radially outwardly into L-shaped slot 32 of sleeve 30 when the button assembly 24 is assembled to provide a means for guiding button member 26 for slidable movement along a path of travel defined by L-shaped slot 32.

Button member 28 is formed to include a pair of axially extending grooves 64 (shown in FIGS. 2–5). As shown in FIG. 2, an external tab 66 is disposed in one of the grooves 64 and arranged to engage the lance 48 formed on button cover 26 to retain button cover 26 in a fixed, unrotatable position on button member 28. Referring to FIG. 3, external tab 66 includes a ramp portion 67 and an axially inwardly directed face 68. Face 68 is sized and shaped to engage lance 48 to prevent axial movement of button cover 26 with respect to button member 28 in direction 17. It is to be understood that an additional tab can also be provided in the opposite groove if more than one lance is provided in the button cover 26.

Button member 28 is also provided with an axially inwardly directed stop face 62. Stop face 62 is positioned so that when button cover 26 is press-fit onto button member 28, stop face 62 abuts open end 52 of button cover 26.

Button member 28 is also formed to include an axially extending internal channel 70 defined by an internal wall 72. Appended to internal wall 72 is an annular rib 74 having a radially extending annular rib face 75 facing in an axially outward direction. The annular rib 74 is made of a resilient material that is rigid enough to hold the locking bar 40 in the axially fixed position shown in FIG. 3 yet deformable enough to allow snap-fit insertion of the nose-like connector 42 through the central hole formed in rib 74 during assembly of the locking bar 40 into the central aperture 70 of button member 28. Annular rib 74 also includes a conical ramp portion 77 configured to allow ramping and mateable coupling with locking bar 40 as described below. Ramp 77 extends in an axially outward, radially inward direction as shown best in FIG. 3. Provision of annular rib 74 eliminates the need for a separate coupling member to interconnect button member 28 to locking bar 40, thus reducing inventory and simplifying assembly of parts needed to make a button assembly for a cylindrical lock. In the illustrated embodiment, annular rib 74 is made of the same plastics material as button member 28 and molded in place on an interior wall inside the central aperture 70 through button member 28.

The flat locking bar 40 is connected to the locking mechanism (not shown) to provide means for actuating the locking mechanism. Locking bar 40 extends in direction 15 into cylindrical sleeve 30 and cooperates with button member 28 to translate axial movement of the button member 28 and cover 26 to the locking mechanism. Locking bar 40 is biased axially outwardly in direction 17 by a spring means (not shown) provided in the cylindrical lockset.

Referring to FIGS. 2 and 3, locking bar 40 includes a nose-like, triangular-shaped connector 42 on its axially outer end and includes a pair of radial flanges 44 axially spaced apart from connector 42. The nose-like connector 42 acts as a head and includes a pair of angled guide walls 39 that engage and ramp on the conical rib face 77 on annular rib 74 during insertion of locking bar 40 into the internal channel 70 in button member 28. The guide walls 39 act to spread rib 74 temporarily enough so that the nose-like connector 42 can be moved or snapped past rib 74 to assume the "snapped-in-place" position shown in FIG. 3. Advantageously, once snapped in place, the nose-like connector 42 is free to rotate relative to locking bar 40 about axis 78 shown in FIG. 3.

Locking bar 40 is formed to include a pair of notches 41 situated between connector 42 and flanges 44 in close proximity to connector 42. Adjacent to notches 41 are two radially extending, axially inwardly directed faces 43 of connector 42. The connector faces 43 are sized relative to rib face 77 to engage the radially inwardly extending circular wall 75 adjacent rib face 77 to couple locking bar 40 to button member 28 in snap-fit relation. Once locking bar 40 is "snapped" in place in internal channel 70, it can be rotated freely about its longitudinal axis relative to button member 28 without fear of disassembly of locking bar 40 from button member 28.

In operation, the button cover 26 can be pushed into the passageway formed inside knob 14 to actuate the locking mechanism provided in the cylindrical lockset. The button cover 26 is mounted on button member 28 and locking bar 40 is coupled to button member 28 for axial movement therewith inside knob sleeve 30. Engagement of the locking tab 58 in the long channel 34 of the L-shaped slot 32 prevents rotation of the button member and locking bar subassembly 28, 40 with respect to the knob sleeve 30. Of course, limited rotation of subassembly 28, 40 with respect to knob sleeve 30 is permitted upon movement of locking tab 58 into the short channel 36 in L-shaped slot 32. Boss 38 on sleeve 30 provides means for retaining the locking tab 58 of button member 28 in the short channel 36.

Assembly of button assembly 24 proceeds as follows. First, button cover 26 is press-fit onto button member 28 so that lance 48 engages face 68 of external tab 66 to prevent rotation of button cover 26 relative to button member 28. Next, button member 28, now carrying button cover 26, is inserted into cylindrical sleeve 30 so that locking tab 58 projects through axially extending channel 34 of L-shaped slot 32. Internal channel 70 of button member 28 is aligned with connector 42 of locking bar 40. Button member 28 is then pushed axially in direction 15 to a position in which nose-like connector or head 42 of locking bar 40 and its angled guide walls 39 ramp against conical ramp portion 77. The guide walls 39 of connector 42 are configured to engage and spread the resilient, deformable annular rib 74 somewhat in a radially outward direction about longitudinal axis 78 to deform annular rib 74 and enlarge the hole in annular rib 74 temporarily so that the connector 42 and flange wall 75 will pass therethrough to allow connector 42 and flange 75 to snap in place as shown in FIG. 3 so that annular rib 74 fits into the pair of notches 41 formed in locking bar 40. In this position, locking tab 58 is positioned in alignment with the circumferentially extending portion 36 of the L-shaped slot 32.

Advantageously, because of the engagement of annular rib 74 into the pair of notches 41 formed in locking bar 40 as shown in FIGS. 4 and 5, connector 42 is retained by annular rib 74, thereby preventing button member 28 from moving axially outwardly with respect to locking bar 40 without blocking rotation of button member 28 relative to locking bar 40 about the longitudinal axis 78 of locking bar 40. Moreover, as shown in FIG. 3, radial flanges 44 of locking bar 40 bear against axially outwardly directed face 57 of button member 28 so that button member 28 is also prevented from axially outward movement relative to locking bar 40.

In addition, button member 28 can be rotated about axis 78 to position button member 28 such that it (and locking bar 40) will not move axially with respect to cylindrical knob sleeve 30. Rotation of button member 28 about axis 78 in the direction indicated by curved arrow 80 in FIG. 4 causes the locking tab 58 on button member 28 to be moved into the short channel 36 of the L-shaped slot 32 formed in knob sleeve 30. Advantageously, axially outwardly directed face 60 of locking tab 58 abuts an axially inwardly directed stop face 39 of knob sleeve 30. When so positioned, button member 28 and locking bar 40 are prevented from moving axially relative to cylindrical knob sleeve 30.

In use, a button assembly 24 disposed in a lock-actuating position as illustrated in FIG. 3 can be moved to a lock-releasing position (shown in phantom in FIG. 3) by rotation of button cover 26 about axis of rotation 78. Rotation of button cover 26 in turn causes button member 28 to rotate in the same direction. Button member 28 must be rotated about axis 78 to snap its locking tab 58 past sleeve boss 38 into the axially extending long channel 34 of L-shaped slot 32 so that button member 28 is free to move axially with respect to cylindrical knob sleeve 30.

When locking tab 58 moves into long channel 23 and is free of stop face 39, locking bar 40, under the biasing force of a spring (not shown) provided in the cylindrical lockset, urges button member 28 in direction 17 to a projected position with respect to inside knob 14. The radial flanges 44 on locking bar 40 bear against the axially inwardly directed face 56 of button member 28 to initiate movement of button member 28 to its projected position. Button member 28 moves axially outward such that button member 28, together with button cover 26 and locking tab 58, is positioned as shown in phantom in FIG. 3. The axially outward extension of locking bar 40 releases the lock mechanism (not shown) so that a user can rotate the outside knob 12 freely to actuate latch assembly 20 and thereby open the door 10.

Figure 6:
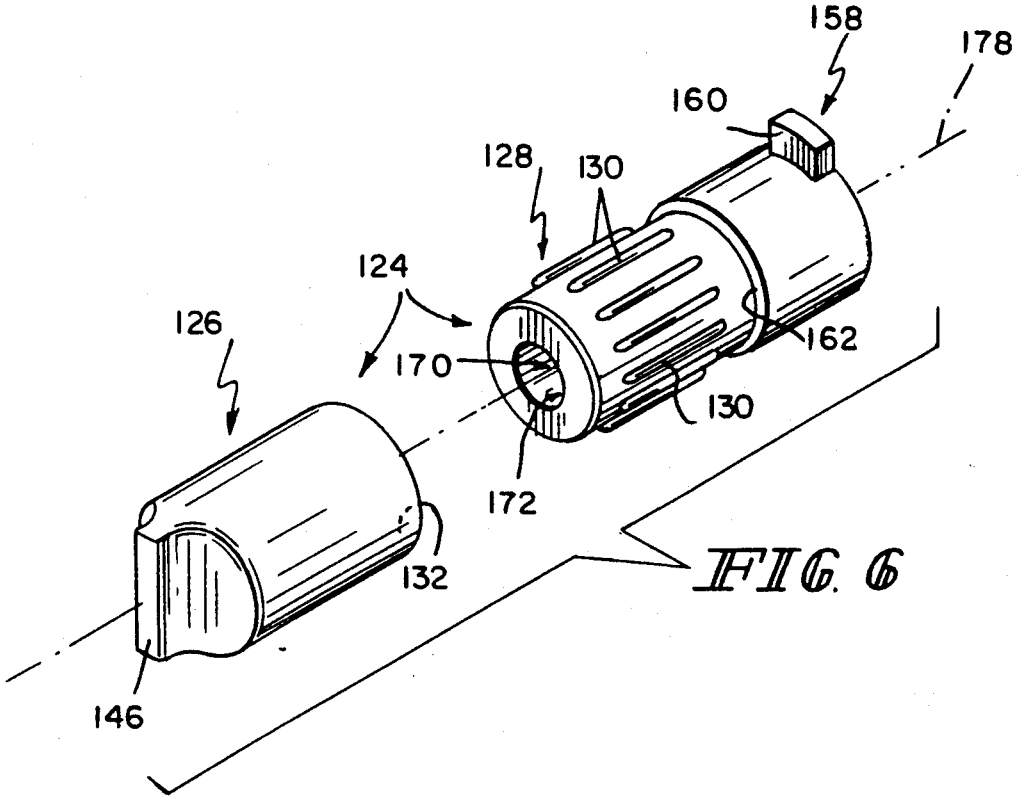
FIG. 6 is an exploded perspective view illustrating another embodiment of a button member and cover in accordance with the present invention.

In alternative embodiments, a button assembly 124 includes a button member 128 provided with knurls 128 on its external surface. The button assembly 124 also includes grip portion 146, locking tab 158, axially outwardly directed face 160, axially inward directed stop face 162, axially extending internal channel 170, internal wall 172, and longitudinal axis 178. As shown in FIG. 6, a plurality of axially extending knurls 130 are formed on the external surface of button member 128. An internal surface 132 of a button cover 126 is press-fit onto button member 128, the provision of knurls 130 eliminates the need for a lance of the type shown in FIG. 2.

Although the invention has been described in detail with reference to the illustrated preferred embodiment, variations and modifications exist within the scope and spirit of the invention as described and defined in the following claims.

What is claimed is:

1. A button assembly for a lockset having a locking mechanism, the button assembly comprising:

a locking bar connected to the locking mechanism, the locking bar including a connector, a button cover, and a button member configured for slidable movement within the lockset, the button cover being mounted on the button member, the button member being mounted on the locking bar, the button member being formed to include means for engaging the connector to retain the locking bar in coupled relation to the button member without blocking rotation of the button member relative to the locking bar about the longitudinal axis of the locking bar, the button member being formed to include a central aperture, the locking bar extending into the central aperture to place the connector in the central aperture, and the engaging means being situated in the central aperture to engage the connector therein.

2. A button assembly for a lockset having a locking mechanism, the button assembly comprising a locking bar connected to the locking mechanism, and a button member mounted on the locking bar, the button member being formed to include means for retaining the locking bar in coupled relation to the button member without blocking rotation of the button member relative to the locking bar about the longitudinal axis of the locking bar, the button member being formed to include a central aperture, the locking bar extending into the central aperture, the retaining means being situated in the central aperture, the retaining means including an annular rib appended to an interior wall of the button member and configured to project radially inwardly into the central aperture, the annular rib being formed to include a hole, and the locking bar including a neck extending through the hole and a head engaging the rib to block withdrawal of the head and neck of the locking bar through the hole to disengage the rib.

3. The button assembly of claim 2, wherein the lockset includes a knob sleeve having a central channel therein, the button member and locking bar are slidably received in the central channel of the knob sleeve for axial reciprocating movement therein, and the button member includes means for engaging the knob sleeve to limit rotation of the button member relative to the knob sleeve to establish said predetermined position of the button member.

4. The button assembly of claim 2, wherein the annular rib includes an axially facing surface situated in the central aperture, and the head includes flange means for engaging the axially facing surface of the annular rib upon passage of the head through the hole formed in the annular rib.

5. The button assembly of claim 2, wherein the annular rib includes a ramp extending in an axially outward, radially inward direction from the interior wall of the button member into the central aperture of the button member and the head includes means for engaging and spreading the annular rib in a radially outward direction about the longitudinal axis of the central aperture so that the annular rib is temporarily deformed to enlarge the central aperture to permit passage of the head therethrough.

6. A button assembly for a lockset having a locking mechanism, the button assembly comprising a locking bar connected to the locking mechanism, and a button member mounted on the locking bar, the button member being formed to include means for retaining the locking bar in coupled relation to the button member without blocking rotation of the button member relative to the locking bar about the longitudinal axis of the locking bar, the button member being formed to include a central aperture, the locking bar extending into the central aperture, the retaining means being situated in the central aperture, the button member including an interior wall defining the central aperture, the retaining means including an annular rib appended to the interior wall, and the locking bar including flange means for engaging the rib.

7. The button assembly of claim 6, wherein the annular rib is formed of a resilient, deformable material to include a hole sized to pass the flange means therethrough during movement of the locking bar therein, the annular rib includes an axially outwardly facing surface, and the flange means engages the axially outwardly facing surface of the annular rib to block withdrawal of the locking bar through the slot upon passage of the flange means through the hole formed in the annular rib.

8. The button assembly of claim 7, wherein the annular rib includes a ramp extending in an axially outward, radially inward direction from the interior wall of the button member into the central aperture and the locking bar further includes a head providing means for engaging and spreading the resilient, deformable annular rib in a radially outward direction about the longitudinal axis of the central aperture to deform the annular rib and enlarge the hole in the annular rib temporarily so that the head and flange means will pass therethrough to permit the flange means to engage the axially outwardly facing surface of the annular rib.

9. A button assembly for a button-actuated lockset having a locking mechanism, the button assembly comprising a button cover, a button member configured for slidable movement within the lockset, the button cover being mounted on the button member, and means for actuating the locking mechanism, the actuating means including a locking bar formed to include a notch and a rib appended to the button member and sized to fit in the notch to retain the button member on the locking bar, the button member being formed to include opposite ends and an axially extending channel defined by an internal wall of the button member, the rib being appended to the wall to lie in spaced relation from each end of the button member and extending radially inwardly from the internal wall into the channel.

10. The button assembly of claim 9, wherein the rib includes a first ramp portion and the locking bar includes nose means for engaging the first ramp portion to widen the axially extending channel temporarily to permit engagement of the rib in the notch as the locking bar is coupled to the button member.

11. The button assembly of claim 9, wherein the rib includes a radially extending rib face directed in a first axial direction, and the locking bar includes a connector having a radially extending connector face directed in an opposite axial direction, the connector face being sized relative to the rib face to engage the rib face to couple the locking bar to the button member.

12. The button assembly of claim 9, wherein the button member includes a tab extending radially outwardly from an external surface of the button member, the button assembly further comprising means formed in the button cover for engaging the tab to retain the button cover in a fixed, unrotatable position on the button member.

13. A button assembly for a button-actuated lockset having a locking mechanism, the button assembly comprising a button cover, a button member configured for slidable movement within the lockset, the button cover being mounted on the button member, the button member having inner and outer ends and being formed to include a central aperture, means for actuating the locking mechanism, the actuating means including a locking bar having a distal end sized to fit through the central aperture, and a rib appended to the button member and arranged to lie in the central aperture and between and in spaced-apart relation to the inner and outer ends to retain the button member on the locking bar for rotation relative to an axis defined by the locking bar.

14. The button assembly of claim 12, wherein the rib is located midway between the inner and outer ends.

15. The button assembly of claim 13, further including a tab appended to the outer end, and wherein the rib is located in axially spaced relation to the tab.

16. A button assembly for a button-actuated lockset, the button assembly comprising a button member having an external surface and being configured for slidable movement within the lockset, the button member including a tab projecting radially outwardly from the external surface, and a button cover including means for engaging the tab to retain the button cover in a fixed, unrotatable position on the button member, the engaging means including an unidirectional lance, the tab including a ramp portion and a face directed axially away from the button cover and positioned to provide a surface for engagement by the lance.

17. A button assembly for a button-actuated within the lockset, the button member comprising a button member configured for slidable movement within the lockset, the button member including a distal end, and a button cover formed to include a hollow interior region for receiving a distal end of the button member therein, the button cover including means for engaging the distal end of the button member in snapping relation during insertion of the distal end of the button member into the hollow interior region.

18. The button assembly of claim 17, wherein the engaging means extends radially inwardly toward the button member.

19. The button assembly of claim 17, wherein the engaging means includes a unidirectional lance positioned so that it snaps into engagement with the tab when the button cover is press-fit onto the button member.

20. A method for assembly of a button assembly, the button assembly including a button member, a locking bar, and a button cover, the method comprising the steps of snapping the button member into engagement with the locking bar, positioning a connector head of the locking bar inside a central aperture formed in the button member so that the button member rotates relative to an axis defined by the locking bar after snapping the button member into engagement with the locking bar, and press-fitting the button cover onto the button member in unrotatable engagement therewith.

* * * * *